US006003969A

United States Patent [19]

Freret, Jr.

[11] Patent Number: 6,003,969

[45] Date of Patent: Dec. 21, 1999

[54] MATRIX PRINTER WITH CANTED PRINTING HEAD

[75] Inventor: Julian Payne Freret, Jr., Los Altos, Calif.

[73] Assignee: Canon Kabushiki Kaisha, Tokyo, Japan

[21] Appl. No.: 08/474,557

[22] Filed: Jun. 7, 1995

[51] Int. Cl.[6] ..... B41J 2/145

[52] U.S. Cl. ..... 347/40; 347/9; 395/108

[58] Field of Search ..... 347/40, 15, 12, 347/16, 9, 5; 395/108, 111

[56] References Cited

U.S. PATENT DOCUMENTS

| | | | |
|---|---|---|---|
| 4,059,183 | 11/1977 | Hoskins | 347/12 X |
| 4,734,868 | 3/1988 | DeLacy | 347/16 X |
| 4,739,415 | 4/1988 | Toyono et al. | 347/9 X |
| 4,972,270 | 11/1990 | Kurtin et al. | 358/296 |
| 5,453,145 | 9/1995 | Beaman et al. | 347/238 X |

FOREIGN PATENT DOCUMENTS

| | | | |
|---|---|---|---|
| 0 031 421 A2 | 7/1981 | European Pat. Off. | 347/40 |
| 1-47556 | 2/1989 | Japan | 395/108 |

*Primary Examiner*—N. Le
*Assistant Examiner*—Shih-Wen Hsieh
*Attorney, Agent, or Firm*—Paul Hentzel

[57] ABSTRACT

A pixel matrix printer 10 scales a pixel input image into a dot matrix output image printed on paper 10R by selectively depositing discrete pixel toner units onto the paper. A toner source array 12A carried by mounting head 12H is responsive to the input image to selectively deposit the discrete toner units. The toner source array has N uniformly spaced toner sources extending along an array axis which forms a known cant relative to the advance direction. A pixel scanner mechanism provides a scanning relative motion between the toner source array and the paper along the scan direction. Each scan cycle forms a raster of N matrix rows as the toner units are deposited. Successive cycles form successive rasters in registration with the paper advance collectively forming the output image on paper 10R. A raster advance mechanism provides advance relative motion between the toner source array and the paper along the advance direction.

22 Claims, 5 Drawing Sheets

MATRIX PRINTER WITH CANTED PRINTING HEAD

TECHNICAL FIELD

This invention relates to matrix printers (i.e. dotmatrix printers), and more particularly to such printers having a printing head mounted at a cant with respect to the direction of paper advance.

BACKGROUND

Heretofore printing heads were mounted in alignment with the direction of travel of the paper in order to maintain the vertical attribute of the input font. The output matrix format normally included all of the pixel rows and columns as the input matrix format. However, sometimes the height of the matrix format was reduced by eliminating entire rows of pixels. For instance, by international convention, group 4 facsimile transmission (FAX) is formatted at 400 dpi (dots per inch) by 400 dpi (or other multiples of 100), and printed 400 scanlines per inch at a pixel density of 400 pixels per inch within each scanline. However, plain paper FAX machines may employ standard dot-matrix printers with a single column of individual dot-forming structures such as ink nozzles or dot-pins formatted at 360 dpi by 360 dpi. This 360 by 360 format presents a 11% pixel mismatch with the 400 dpi of group 4, which if unresolved would cause the characters printed by the receiving FAX machine to be approximately 11% larger than the characters on the document transmitted. Faxing a standard 8.5" by 11" letter would require a non-standard 9.4" by 12.2" printout sheet. Heretofore this print density problem was resolved by increasing the horizontal scan dpi to produce 400 dpi horizontal printing, plus deleting every tenth scanline causing 400 transmitted scanlines to be printed as only 360 scanlines. The resulting loss of data produced a visible aberration in the image with a corresponding loss of print quality.

SUMMARY

It is therefore an object of this invention to provide a canted printing head for scaling the output matrix format.

It is a further object of this invention to provide such a canted printing head in which all of the pixels of the input format are included in the output format.

It is a further object of this invention to provide such a canted printing head in which the cant may be changed to alter the pixel row density of the output matrix.

It is a further object of this invention to provide such a canted printing head in which the scan velocity may be changed to alter the pixel column density of the output matrix.

It is a further object of this invention to provide such a canted printing head in which the toner deposition rate may be changed to alter the pixel column density of the output matrix.

It is a further object of this invention to provide such a canted printing head which generates less printing noise than non-canted heads.

Briefly, these and other objects of the present invention are accomplished by providing a pixel matrix printer for scaling an input image into an output image. The input image is presented in an input pixel matrix formed by matrix rows and columns of pixels. The output image is printed in an output pixel matrix formed by rows of pixels along a row scan direction and by columns of pixels along a row advance direction. The output image is printed by selectively depositing discrete pixel toner units on a recording medium. An input buffer receives the input image presented in the input matrix. A toner source array is responsive to the input image to selectively deposit the discrete toner units. The toner source array has N uniformly spaced toner sources extending along an array axis. A recording medium support is positioned proximate the toner source array for supporting the recording medium during the deposition of the toner units. A pixel scanner mechanism provides a scanning relative motion between the toner source array and the recording medium along the scan direction generally perpendicular to the advance direction. The scanning relative motion forms successive bands or rasters of N matrix rows as the toner units are deposited. The rows extend along the scan direction of the output image and have uniform inter-row spacing along the advance direction. The scanning relative motion spatially positions the matrix columns to establish a matrix column density along the scan direction in scaled correspondence with the input image. An array mounting head secures the toner source array at a cant relative to the advance direction for determining the uniform inter-row spacing along the advance direction of the N matrix rows. The N matrix rows form the raster to establish a matrix row density of the matrix rows along the advance direction in scaled correspondence with the input image. A raster advance mechanism provides advance relative motion between the toner source array and the recording medium along the advance direction generally perpendicular to the scan direction. The advance relative motion spatially positions the each raster of N matrix rows in the advance direction of the output matrix.

BRIEF DESCRIPTION OF THE DRAWING

Further objects and advantages of the present printer and the operation of canted head will become apparent from the following detailed description and drawing (not drawn to scale) in which.

Figure 1:
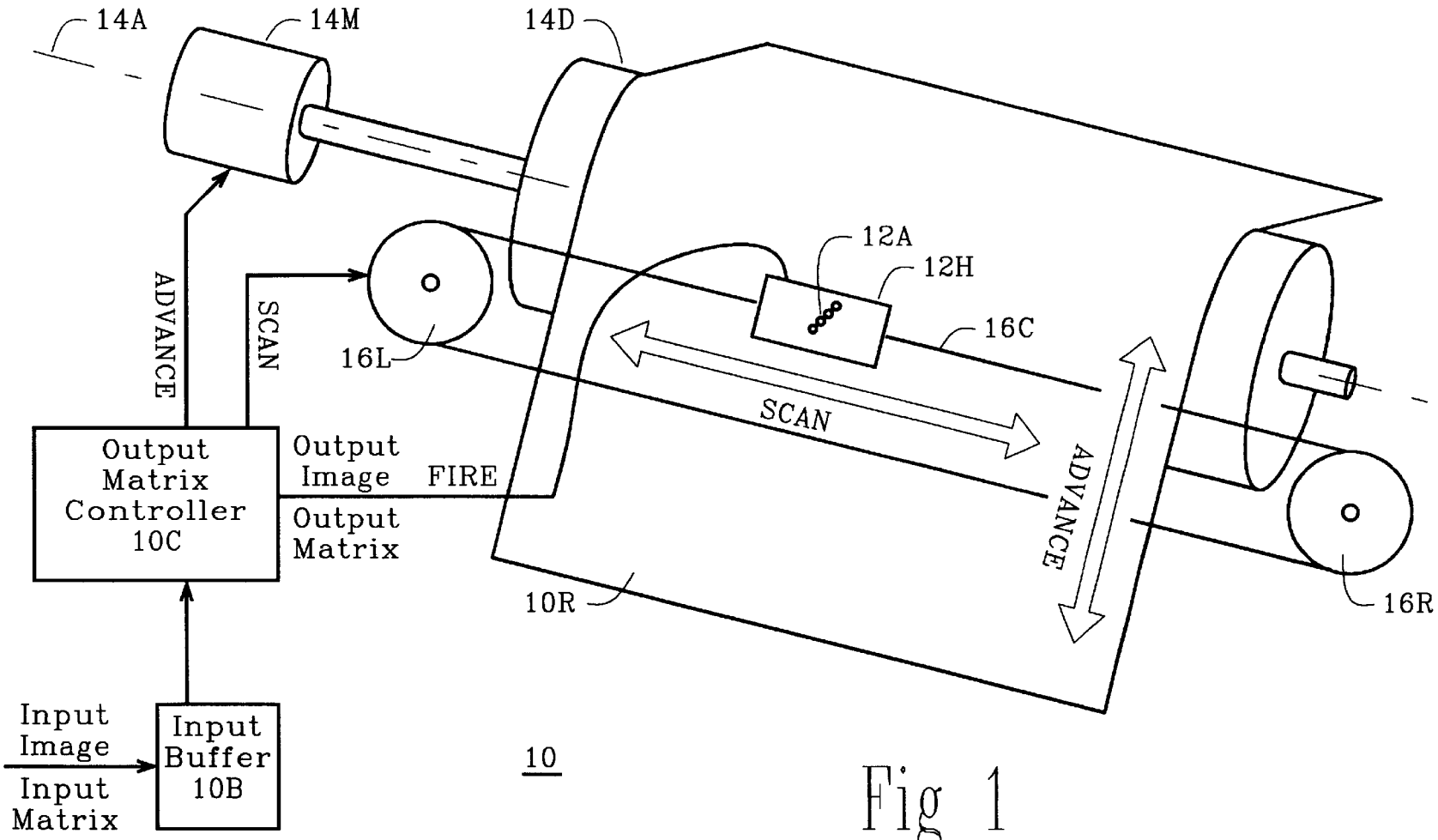
FIG. 1 is a perspective schematic view of the present printer with the canted head.

The elements of the invention are designated by two-digit reference numerals in the above figures. The first digit indicates the figure in which that element is first disclosed or is primarily described. The second digit indicates like features and structures throughout the figures. Some reference numerals are followed by a letter which indicates a subportion or related feature of that element.

GENERAL EMBODIMENT—(FIG. 1)

A pixel matrix printer 10 scales a pixel input image into a dot-matrix output image printed on recording medium 10R. The input image is presented to the matrix printer in an input pixel matrix formed by matrix rows and matrix columns of pixels. The output image is printed in an output pixel matrix by selectively depositing discrete pixel recording unit such as toner units on the recording medium. The output matrix is formed by rows of pixels along a row scan direction (indicated by SCAN arrow) and by columns of pixels along a row advance direction (indicated by ADVANCE arrow). The scan direction is across the recording medium and is generally perpendicular to the advance direction which is the direction of movement of the recording medium. An input buffer 10B within printer 10 receives the input image from a suitable pixel data source such as work stations, computers, facsimile (fax) machines, and archival storage devices.

Figure 3:
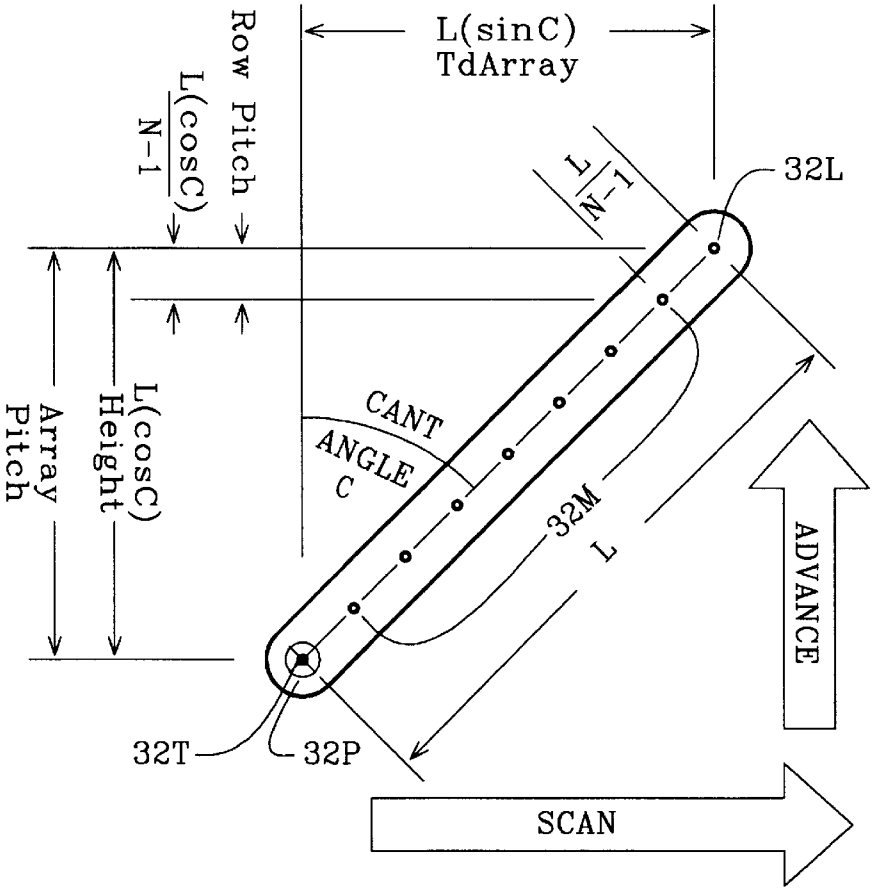
FIG. 3 is a plan view of the toner source array showing the showing the sine and cosine relationships.

A suitable record element array such as toner source array 12A carried by mounting head 12H is responsive to the input image within the input buffer to selectively deposit the discrete toner units onto the recording medium. The toner source array has N uniformly spaced toner sources extending along an array axis which forms a known cant (as shown in FIG. 3) relative to the advance direction. The structure within the toner sources for delivering the toner units from the toner sources onto recording medium 10R may be any suitable propulsion mechanism including piezoelectric transducers, thermal propulsion chambers, and impact pins. The propelled toner units are typically round, forming a round toner unit dot on the recording medium. However the toner units may be other shapes. The amount of toner deposited in each toner unit may be controlled to provide lighter or darker printed images and to create greyscale printed images. Smaller toner units may be employed at higher output densities. A suitable recording medium support such as drum platen 14D is mounted proximate the toner source array for supporting the recording medium during the deposition of the toner units. The recording medium may be any suitable substance capable of retaining a toned image including paper, vellum and mylar film.

A pixel scanner mechanism provides a scanning relative motion between the toner source array and the recording medium along the scan direction. The pixel scanner mechanism may be formed by a suitable linear movement mechanism such as drive cable 16C shown in the embodiment of FIG. 1. The drive cable moves the toner source array bidirectionally by means of left drive wheel 16L which establishes a left scan cycle, and right drive wheel 16R which establishes a right scan cycle. Each scan cycle forms a raster of N matrix rows as the toner units are deposited. Successive cycles form successive rasters in registration with the paper advance, collectively forming the output image on paper 10R. The rows extend along the scan direction of the output image and have a uniform inter-row spacing in the advance direction. The scanning motion spatially positions the matrix columns to establish a matrix column density along the scan direction in the printed output image, which columns are in scaled correspondence with the input image.

Array mounting head 12H is connected to the drive cable, and is supported by a guide track (not shown) to hold the toner source array at a constant cant relative to the advance direction. The constant cant determines a constant uniform inter-row spacing and establishes a constant matrix row density in scaled correspondence with the input image. Alternatively, the toner source array may be pivoted with respect to the advance direction as shown in FIGS. 3, 4, 5 and 6.

A raster advance mechanism provides advance relative motion between the toner source array and the paper along the advance direction. The advance mechanism may be formed by a suitable linear movement mechanism such as drum platen 14D and rotary advance motor 14M mounted on axis 14A of the drum as shown in the embodiment of FIG. 1. The drum frictionally engages the surface of the paper and the advance motor rotates, causing the drum to move the paper. The advance motion spatially positions each raster of N matrix rows in the advance direction of the printed output image. A bidirectional advance may be provided by reversing the rotation of the advance drive motor. A tractor type advance drive may be employed for perforated paper, in which case the platen is a flat, low-friction support surface.

OUTPUT MATRIX CONTROLLER—(FIG. 2)

An output matrix controller 10C connected between input buffer 10B and toner source array 12A is responsive to the input image in the input buffer. The output matrix controller regulates the deposition of the discrete toner units by the toner source array to form N rows of output image. The toner source array is responsive to the output matrix controller for controlling the deposition rate of the discrete toner units to establish the matrix column density. The toner units are propelled from the toner source array in response to FIRE commands from toner source driver 22D. Delay generator 20G between the input buffer and the toner source driver delays the input data to accommodate the scanning velocity of the toner source array. The pixel scanner mechanism (shown in FIG. 1) is responsive to scanner driver 26D within the output matrix controller for controlling the scanning motion between the toner source array and the paper.

Column alignment compensator 26C within the output matrix controller increases (or decreases) the delay provided by the delay generator to compensate for the cant of the toner source array in order to align the matrix columns of the output matrix with the advance direction (see Eq-2). Without alignment compensation, the printed output image would be slanted in the direction of the cant similar to italic fonts.

Raster advancement compensator 24R within the output matrix controller compensates the paper advance for the cant in order to maintain a continuous output image free of banding artifacts (see Eq-4). Without the advance compensation, an inter-raster band may appear forming a discontinuity (overlapping or underlapping) between adjacent rasters. Advance driver 24D is responsive to the raster advance compensator to drive the rotary advance motor which rotates the drum platen and advances the paper.

Shift compensator 26S within the output matrix controller increases (or decreases) the delay to compensate for new settings of the cant in order to maintain the left/right margins of the output matrix (see Eq-6). Without margin compensation, any pivoting in the array mounting head would generally introduce a shift in the margins.

COLUMN ALIGNMENT—(FIG. 3)

Figure 4:
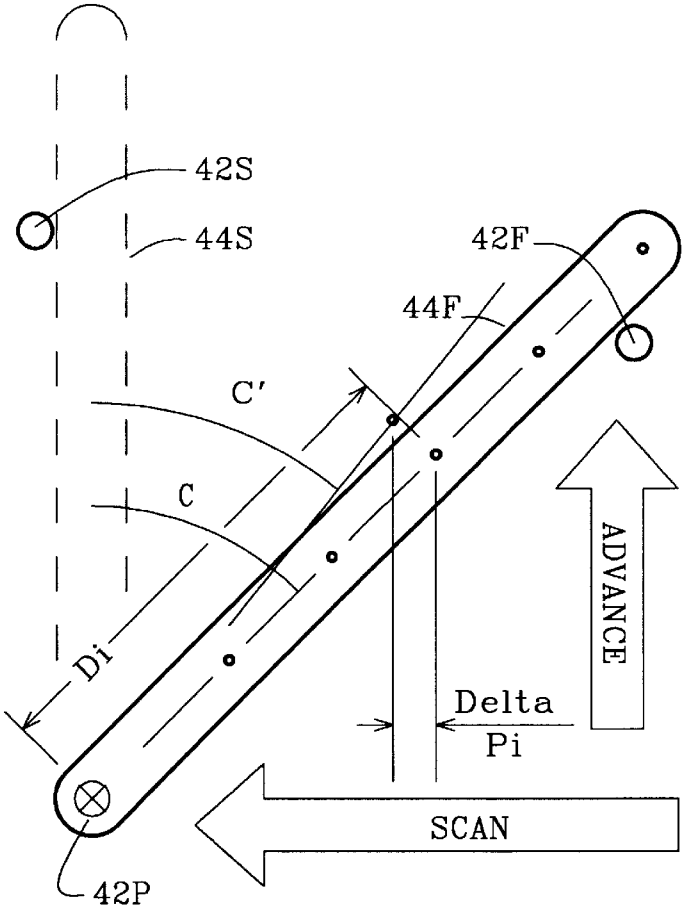
FIG. 4 is a plan view of a pivoting toner source array showing two positions.

The cant of the toner source array together with the scanning motion SCAN defines a lead toner source 32L (see FIG. 3) in the most forward position of the array along the scan direction. A corresponding tail toner source 32T is in the most rearward position of the array. The remaining N-2 toner sources are mid-toner sources 32M uniformly spaced between the lead toner source and the tail toner source in the middle positions within the array. The pixel scanner mechanism may be bidirectional providing scanning motion first one way along the scan direction (to the right as shown in FIG. 3) thereby defining the lead toner source and tail toner source, and then the other way along the scan direction (to the left as shown in FIG. 4) interchanging the lead toner source and the tail toner source.

Column alignment compensator 26C within the output matrix controller provides alignment compensation by progressively delaying the FIRE commands. The deposition of the discrete toner units from the toner source array is delayed, causing the matrix columns of the output matrix to align with the advance direction. The lead toner source has the minimum time delay, and the tail toner source has the maximum time delay. The mid-toner sources have progressively longer time delays from the lead toner source to the tail toner source. The time delays become progressively longer from the lead toner source to the tail toner source in accordance with the alignment delay relationship;

$$Tdi=(\text{TdArray})\ (i-1)/(N-1) \qquad \text{(Eq-1)}$$

where

Tdi is the progressive time delay of the ith toner source in which i=1 for the lead toner source and i=N for the tail toner source, TdArray is the total time delay between the lead source and the tail source, and N is the number of toner sources in the array.

The N−1 term reflects the fact that while the toner source array has N individual toner sources, there are only N−1 intervals between the toner sources. The value of i is a integer between 1 and N (inclusive). In the above relationship (Eq-1), the progressive delay for the lead toner source (i=1) is zero.

The total delay TdArray is calculated from the length of the array, the array velocity, and the cant angle C according to:

$$\text{TdArray}=(L/V)\ (\sin C),$$

where

L is the length of the array from the lead toner source to the tail toner source, V is the velocity of the scanning motion, and C is the cant angle between the array direction and the advance direction.

When the expression for TdArray is substituted in Eq-1, the above alignment delay relationship becomes the alignment sine relationship:

$$Tdi=(L/V)\ (\sin C)\ (i-1)/(N-1) \qquad \text{(Eq-2)}$$

Figure 2:
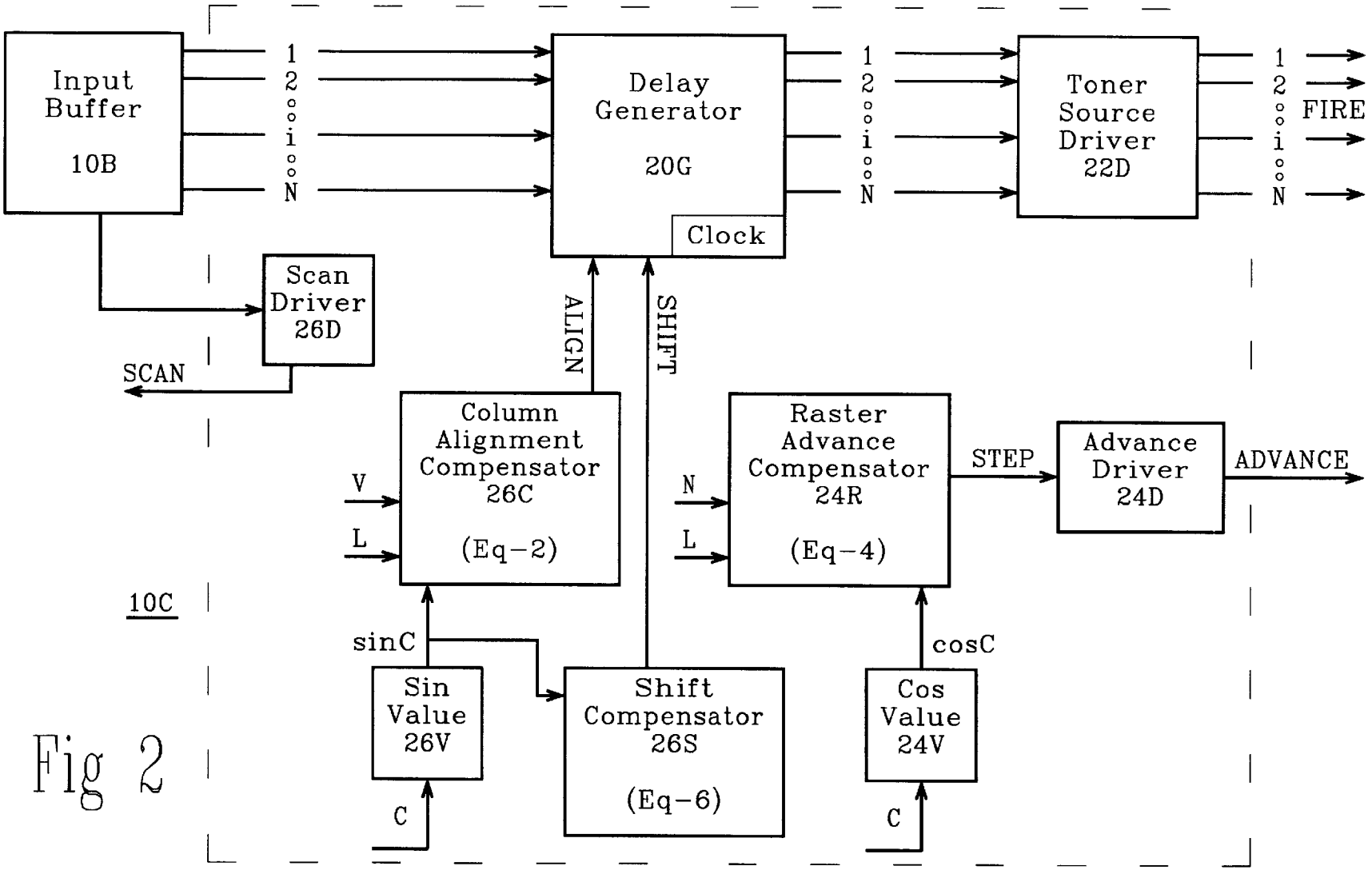
FIG. 2 is a block diagram of the output matrix controller shown in FIG. 1 showing the column alignment, paper advance and margin shift features of the canted head.

Each Tdi is calculated by column alignment compensator 26C (see FIG. 2) to provide the required alignment delay (ALIGN). Sine value device 26V provides the value for the sine function of the cant angle C. The length L is fixed and entered into the output matrix controller during an initial setup procedure. The distance L from the lead toner source to the tail toner source is measured from center to center. The pitch of the toner source array is L/(N−1). The velocity V is normally constant and also entered initially. However velocity V may be changed to accommodate "letter quality" mode (high resolution printing at a low velocity) and "draft" mode (low resolution printing at a high velocity). The delay generator receives the ALIGN signal and delays the FIRE command to the individual toner sources a corresponding time interval.

The progressive delay of the toner unit deposition results in a quieter printing operation. In prior printers without a canted head (cant angle equal zero), printing a vertical stroke required all of the toner sources in the array to simultaneously fire and deposit toner units in a vertical column. This coincidence of activity produced a collective toner propulsion click from the toner sources, immediately followed by the impact noise of the toner units. Vertical strokes are very common in western fonts. Each vertical stroke generates a high level print sound which run together in a noticeable printer noise. In the current canted head printer, the toner depositions which form each vertical stroke are not simultaneous; but are dispersed over the time period TdArray. The printer noise is typically a series of single, low level, toner unit depositions which blend together in a general whirring sound.

RASTER ADVANCE—(FIG. 3)

Each toner source of the N toner sources forms a row of toner deposits in the raster of N rows (see FIG. 3) as toner source array 12A scans along the scan direction. Due to the particular geometry of the FIG. 3 embodiment (left-to-right scan with positive cant), the top row is deposited by lead toner source 32L, the bottom row is deposited by tail toner source 32T, and the mid rows are deposited by mid toner sources 32M.

The inter-row spacing or pitch of the matrix rows is the inverse of the density of the matrix rows along the advance direction. The inter-row spacing is determined by the cant in accordance with the pitch relationship:

$$\text{Matrix Row Pitch}=(\text{Array Pitch})\ (\cos C) \qquad \text{(Eq-3)}$$

where

Array Pitch is the inter-source spacing of the uniformly spaced toner sources along the array axis, and C is the cant angle between the array direction and the advance direction.

The array pitch is the length L of the array divided by N−1, where N is the number of toner sources in the array.

Successive rasters are positioned on the paper by the raster advance mechanism which is responsive to the output matrix controller. Raster advance compensator 24R and advance driver 24D determine the advance motion between the toner source array and the paper along the advance direction. The raster advance mechanism provides a step advance motion after each scan cycle between successive rasters of N matrix rows. An inter-raster separation between the successive rasters is preferably equal to the uniform inter-row spacing between the rows within each raster in order to eliminate banding in the output image. All of the rows of the input matrix appear in the output matrix without the row deletion noted in the prior art printers. These earlier printers dropped rows of pixels from the output format in order to reduce the height of the format. The information in these deleted rows was lost. The present canted head preserves all of the pixel rows and all of the input data.

The uniform inter-row spacing along the advance direction is determined by the cant in accordance with the spacing relationship:

$$\text{Inter-row Spacing}=L\ (\cos C)/(N-1) \qquad \text{(Eq-4)}$$

where

L is the length of the array from the toner source at one end of the array to the toner source at the other end of the array, N is the number of toner sources in the array, and C is the cant angle between the array direction and the advance direction.

The step advance (STEP) between successive rasters includes the N−1 inter-row spacings of the raster height (the dimension in the advance direction) plus one inter-raster separation as determined by the cant in accordance with the step relationship:

Step Advance=($N$−1) Inter-row+One Inter-raster Spacing Separation

Step Advance=L (cos $C$)+L (cos $C$)/($N$−1)

Step Advance=LN (cos $C$)/($N$−1) (Eq-5)

Each advance value is calculated by raster advance compensator 24R (see FIG. 2) to provide the required step advance. Cosine value device 24V provides the value for the cosine function of the cant angle C. Advance driver 24D is responsive to the raster advance compensator and provides a STEP signal to the raster advance mechanism. In the above step relationship the inter-raster separation is equal to a single inter-row spacing to prevent a noticeable inter-raster banding caused by overlapping or underlapping of adjacent rasters.

PIVOTING ARRAY EMBODIMENTS—(FIGS. 3, 4, 5 and 6)

The toner source array may be fixed to provide a fixed cant. Alternatively, the array may be pivotally secured by the array mounting head about pivot axis 32P (see FIG. 3) to permit changing the cant. Output matrix controller 10C compensates the alignment delay in response to the altered cant to correspondingly alter the ALIGN signal to delay generator 20G and to maintain the pixel column alignment. The output matrix controller also compensates the matrix row density (or pitch) to alter the STEP command to maintain the bandless output image as the paper is stepped along the advance direction.

Figure 5:
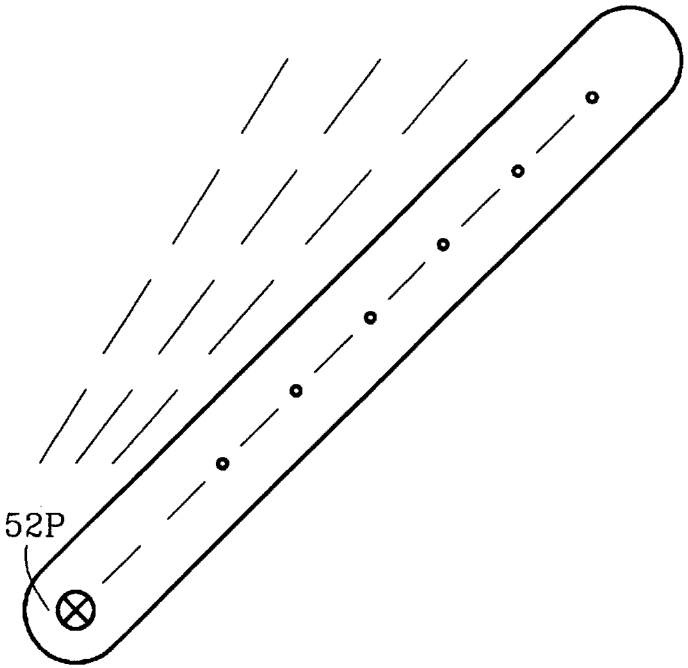
FIG. 5 is a plan view of a pivoting toner source array showing continuous positioning with the pivot axis located on the array axis.

The toner source array may be pivotally secured about pivot axis 42P (see FIG. 4) in a two position embodiment. The mounting head is canted between a first angle position 44F (shown in solid lines) having a first matrix row density (or pitch), and second angle position 44S (shown in dashed lines) having a second matrix row density (or pitch). In the embodiment of FIG. 4, the second cant angle is vertical, yielding the minimum row density (or maximum pitch). A first pivot stop 42F between the array mounting head and the toner source array limits the pivoting in one direction, defining the first cant angle. A second pivot stop 42S limits the pivoting in the other direction defining the second cant angle. FIG. 5 shows a continuous pivot embodiment in which the toner source array is pivotally secured about pivot axis 52P to permit changing the cant continuously to any angle between a first cant and a second cant.

In the fixed-cant embodiment, output matrix controller 10C requires only one value for sine C and one value for cosine C. These single values may be entered into compensators 26C, 24R, and 26S during manufacture or during the initial setup procedure. In the two-cant angle embodiment of FIG. 4, the output matrix controller requires two values for sine C and two values for cosine C. These values may be stored in sine device 26V and cosine device 24V, and entered into the compensators as required. In the continuous cant angle embodiment of FIG. 5, the output matrix controller requires a series of values for the sine function and for the cosine function. These values may be provided on an ad-hoc basis by a sine look-up table in sine device 26V and a cosine look-up table in cosine device 24V. Alternatively, each value may calculated by the sine device and the cosine device during setup or in response to each change in the cant.

MARGIN SHIFT—(FIG. 4)

Pivoting the toner source array from a prior cant angle C to a new cant angle C' alters the position of the toner source array along the scan direction in accordance with the margin shift relationship:

delta $P$=$D$ (sin $C'$−sin $C$) (Eq-6)

where delta P is the alteration in position of the toner source array along the scan direction, D is the distance between the toner source array and the pivot axis, C is the prior cant angle, and C' is the new cant angle.

The output matrix controller may further compensate the deposition of the toner units to prevent the new cant angle C' from causing a shift of the output image along the scan direction relative to the recording medium. Without shift compensation, C' would cause a shift in the left hand and right hand margins at the end of each scan cycle. The delta Pi delay increment (SHIFT) is calculated by shift compensator 26S and presented to delay generator 20G along with the alignment delay (ALIGN) from column alignment compensator 26C.

Figure 6:
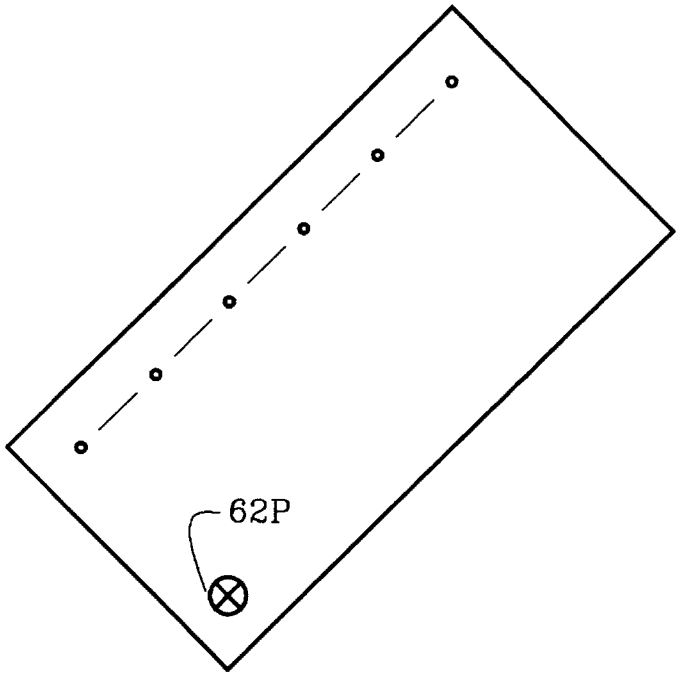
FIG. 6 is a plan view of a pivoting toner source array showing continuous positioning with the pivot axis offset from the array axis.

In the FIG. 3 case, pivot axis 32P is coincident with the toner source at one end of the toner source array. In the FIG. 4 case, pivot axis 42P is displaced from the tail toner source but positioned along the array axis. FIG. 6 shows the general case in which pivot axis 62P is neither coincident with the end toner source nor positioned along the array axis. In the simple, coincident case of FIG. 3, the margin shift is minimal. In the displaced case of FIG. 4, the margin shift is greater and is proportional to the distance along the array axis between the adjacent toner source and the pivot axis.

Figure 7B:
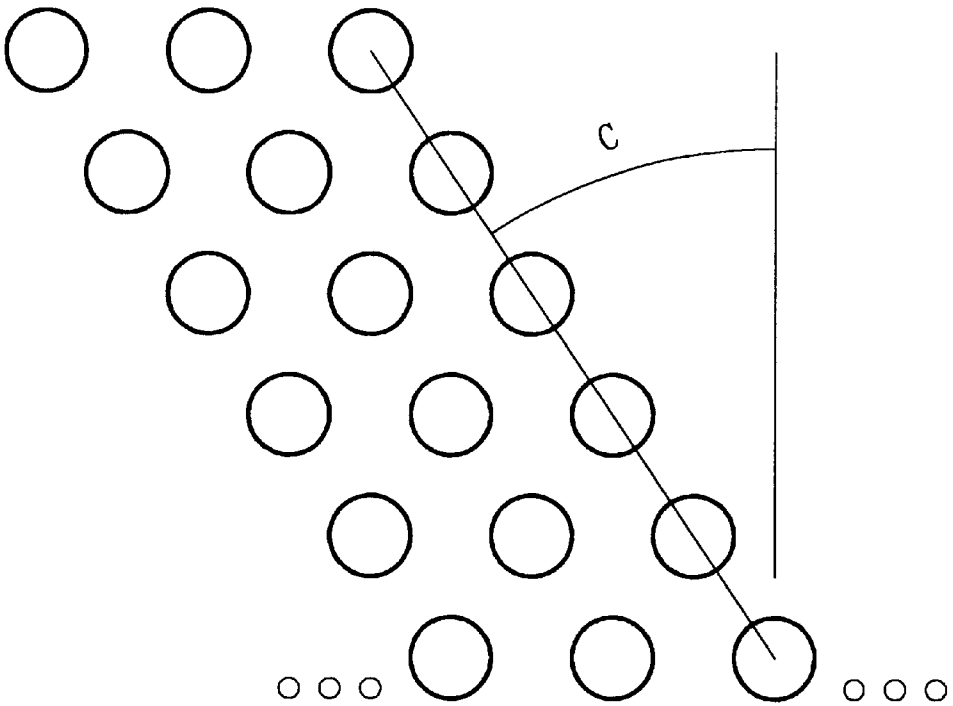
FIG. 7B shows the output matrix from matrix controller 10C of FIG. 1.
Figure 7A:
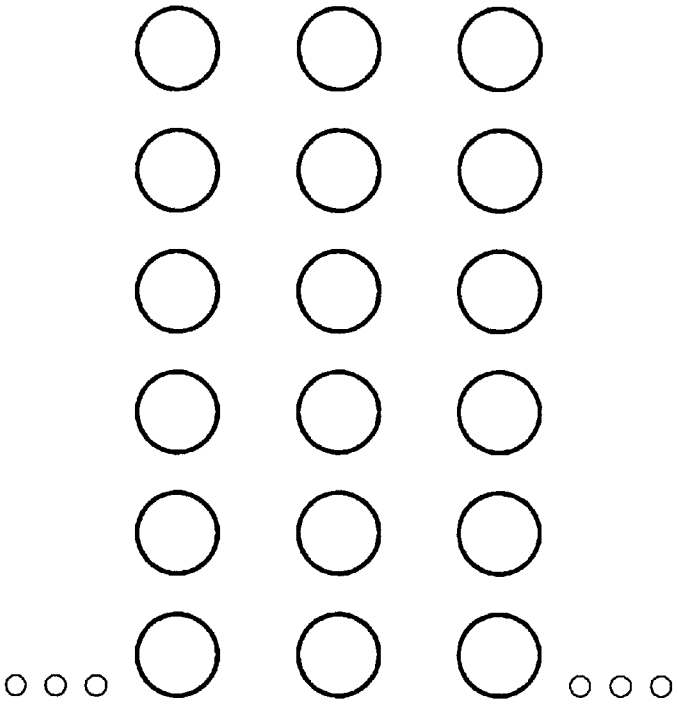
FIG. 7A shows the input matrix to input buffer 10 of FIG. 1.

PIXEL MATRICES (FIGS. 7A and 7B)

The input image is presented to input buffer 10B as an input data stream which when formatted forms an input matrix format of columns and rows. The input matrix is typically in aligned relationship as shown in FIG. 7A. The output image from matrix controller 10C to toner source array 12A is also a data stream which when formatted forms an output matrix of columns and rows. The column alignment of the output matrix is compensated by column alignment compensator 26C as shown in FIG. 7B to counteract cant angle C of toner source array 12A. The column pixels are progressively delayed by delay generator 20G introducing a reverse cant angle C. For convenience of illustration, only three columns of six rows are shown in the aligned input matrix of FIG. 7A with the corresponding three columns in the canted output matrix of FIG. 7B.

SPECIFIC EMBODIMENTS

The following particulars of the canted head printer are given as illustrative examples of a change in output matrix produced by the cant.

Fixed Head Example—A 360 dpi toner source array is canted at a fixed angle of 25.8 degrees (the arc cosine of 360/400) to increase the row density from 360 dpi (dots per inch), a common print head density, to 400 dpi (group 4 fax standard). The column density may be increased from 360 dpi to 400 dpi by progressively compensating the deposition rate of the toner units. A 380 dpi print head would require a cant of 18.2 degrees to provide 400 dpi printing.

Two Angle Example—The toner source array pivots between a vertical 360 dpi mode and a 25.8 degree 400 dpi mode. One printing machine with a two position mode switch may then function as a standard 360 dpi printer and also as a 400 dpi FAX printer. The deposition rate is compensated to suit each mode.

Three Angle Example—The toner source array pivots between a vertical 360 dpi mode, a 25.8 degree 400 dpi mode, and a 27.5 degree 406 dpi mode. One printing machine with a three position mode switch may then function as a standard 360 dpi printer, and a 400 dpi FAX group 4 printer, and also as a 406 dpi super-fine FAX group 3 printer. By printing each row of 392 dpi pixels twice, the group 3 vertical resolution of 196 dpi may be achieved.

The timing of the toner sources may involve clock round-off error introducing a slight wiggle "lay down error" along the edges of the vertical strokes of each character. However, at conventional paper speeds and scanning speeds, and at typical clock speeds, the edge wiggle is imperceptible. The information given above is not intended as defining the limitations of the invention. Numerous other applications and configurations are possible.

INDUSTRIAL APPLICABILITY

It will be apparent to those skilled in the art that the objects of this invention have been achieved as described hereinbefore by providing a canted printing head for scaling the output matrix format. All of the pixels of the input format are included in the output format. The cant and the scan velocity and the toner deposition rate may be changed to alter the pixel density within the rows of the output matrix. The canted printing head generates less printing noise than noncanted heads.

CONCLUSION

Clearly various changes may be made in the structure and embodiments shown herein without departing from the concept of the invention. Further, features of the embodiments shown in the various figures may be employed with the embodiments of the other figures.

Therefore, the scope of the invention is to be determined by the terminology of the following claims and the legal equivalents thereof.

I claim as my invention:

1. A pixel matrix printer for scaling an input image presented in an input pixel matrix formed by matrix rows of pixels and matrix columns of pixels into an output image printed in an output pixel matrix formed by matrix rows of pixels along a row scan direction and by matrix columns of pixels along a row advance direction by selectively forming discrete pixel recording units on a recording medium, comprising:

input means for receiving the input image presented in the input matrix;

a record element array having N uniformly spaced record elements, each record element having a position extending along an array axis, and responsive to the output pixel matrix to selectively form the discrete recording units onto the recording medium;

scanner means for providing a scanning relative motion with a scanning relative velocity between the record element array and the recording medium along the scan direction generally perpendicular to the advance direction, the scanning motion forming successive rasters of the matrix rows, each matrix having N rows as the recording units are formed, the N matrix rows extending along the scan direction of the output image, and having a uniform inter-row spacing along the advance direction, the scanning motion spatially positioning the matrix columns of the output matrix to establish a matrix column density along the scan direction in scaled correspondence with the input image;

array mounting means for mounting the record element array at a cant angle relative to the advance direction for determining the uniform inter-row spacing along the advance direction of the N matrix rows forming the raster to establish a matrix row density of the matrix rows along the advance direction in scaled correspondence with the input image;

output matrix controller connected between the input means and the record element array, responsive to the input image in the input means for regulating the rate of formation of the discrete recording units by the record element array to form the output image, and responsive to the input means for providing an angle compensation for the cant angle of the record element array to align the matrix columns of the output matrix with the advance direction; and the record element array pivotally mounted by the array mounting means about a pivot axis to permit changing the cant angle from a first cant angle to a second cant angle which alters the position of the record element array along the scan direction in accordance with the source position relationship:

$$\text{delta } P[i]=D[i]\ (\sin C'-\sin C)$$

where delta P is the alteration in position of the record element array along the scan direction, D is the distance along the record element array between the record element array and the pivot axis, C is the first cant angle, and C' is the second cant angle, and the output matrix controller further providing a shift compensation in the formation of the recording units to prevent the second cant angle C' from causing a shift of the output image along the scan direction relative to the recording medium due to the source position relationship.

2. The matrix printer of claim 1, wherein the cant angle of the record element array and the scanning motion establish the record elements as a lead record element of the record element array in a most forward position of the array along the scan direction, and a tail record element of the record element array in a most rearward position of the array along the scan direction, and mid-record elements of the record element array in spaced middle positions within the array between the lead record element and the tail record element; and the output matrix controller progressively delays the formation of the discrete recording units by the record element array, with the lead record element having the minimum time delay and the tail record element having the maximum time delay and each of the mid-record elements having a progressively longer time delay from the lead record element to the tail record element, causing the matrix columns of the output matrix to align with the advance direction.

3. The matrix printer of claim 2, wherein the scanning relative motion is bidirectional first in one direction along the scan direction defining the lead record element and then in record element and then in the other direction along the scan direction reversing the lead record element and the tail record element.

4. The matrix printer of claim 2, wherein the time delays become progressively longer from the lead record element to the tail record element in accordance with the delay relationship:

$$Tdi=(Td\text{Array})\ (i-1)/(N-1)$$

where

Tdi is the progressive time delay of the ith one of the spaced record elements in which i=1 for the lead record element and i=N for the tail record element, TdArray is the total time delay between the lead record element and the tail record element, and N is the number of record elements in the array, and the further relationship:

$$Tdi=(L/V)\ (\sin C)\ (i-1)/(N-1)$$

where

L is the length of the array along the array from the lead record element to the tail record element, V is the scanning velocity of the scanning motion, and C is the cant angle between the array direction and the advance direction.

5. The matrix printer of claim 1, wherein the scanner means is responsive to the output matrix controller for controlling the scanning motion between the record element array and the recording medium to establish the matrix column density.

6. The matrix printer of claim 1, wherein the record element array is responsive to the output matrix controller for controlling the rate of formation of the discrete recording units to establish the density of the matrix column.

7. The matrix printer of claim 6, wherein the record elements in the array are responsive to the output matrix controller to determine the amount of toner formed in each recording unit.

8. The matrix printer of claim 1, further comprising:

raster advance means for providing advance relative motion between the record element array and the recording medium along the advance direction generally perpendicular to the scan direction, which spatially positions each raster of N matrix rows in the advance direction of the output matrix, the raster advance means is responsive to the output matrix controller for determining the advance motion between the record element array and the recording medium along the advance direction to provide a uniform inter-raster separation between the successive rasters of N matrix rows, which inter-raster separation is equal to the uniform inter-row spacing between the rows within the raster.

9. The matrix printer of claim 8, wherein the advance motion is bidirectional in each direction along the advance direction.

10. The matrix printer of claim 8 wherein the inter-row spacing of the matrix rows along the advance direction is determined by the cant angle in accordance with the pitch relationship:

$$\text{Matrix Row Pitch}=(\text{Array Pitch})\ (\cos C)$$

where

Array Pitch is the inter-row spacing of the uniformly spaced record elements along the array axis, and C is the cant angle between the array direction and the advance direction.

11. The matrix printer of claim 10 wherein the record element array has a record element at each end thereof, and wherein the uniform inter-row spacing along the advance direction is determined by the cant angle in accordance with the spacing relationship:

$$\text{Inter-row Spacing}=L\ (\cos C)/(N-1)$$

where

L is the length of the array along the array from the record element at one end of the array to the record element at the other end of the array, N is the number of record elements in the array, and C is the cant angle between the array direction and the advance direction.

12. The matrix printer of claim 11, wherein the raster advance means provides a step advance motion between successive rasters.

13. The matrix printer of claim 12 wherein the step advance between successive rasters defines a dimension of the raster in the advance direction plus the inter-raster separation as determined by the cant angle in accordance with the step relationship:

$$\text{step advance}=(N-1)\ \text{Inter-row+Inter-raster Spacing Separation}$$

$$\text{step advance}=L\ (\cos C)+L\ (\cos C)/(N-1)$$

$$\text{step advance}=LN\ (\cos C)/(N-1)$$

where

L is the length of the array along the array from the record element at one end of the array to the record element at the other end of the array, N is the number of record elements in the array, and C is the cant angle between the array direction and the advance direction.

14. The matrix printer of claim 10, wherein the record element array is pivotally mounted by the array mounting means about a pivot axis to permit changing the cant angle from the first cant angle to the second cant angle with a corresponding change in the matrix row density, and the output matrix controller is responsive to the second cant angle to correspondingly alter the advance motion along the advance direction.

15. The matrix printer of claim 14, wherein the record element array is pivotally mounted to permit changing the cant angle between the first cant angle having a first matrix row density and the second cant angle having a second matrix row density, and the output matrix controller is responsive to the first and second cant angles to correspondingly alter the advance motion along the advance direction.

16. The matrix printer of claim 15, further comprising a first pivot stop means between the array mounting means and the record element array for defining the first cant angle, and a second pivot stop means between the array mounting means and the record element array for defining the second cant angle.

17. The matrix printer of claim 12, wherein the record element array is pivotally mounted to permit changing the cant angle continuously to any angle between the first cant angle having a first matrix row density and the second cant angle having a second matrix row density, and the output matrix controller is responsive to the first and second cant angles to correspondingly alter the progressive delay.

18. The matrix printer of claim 14, wherein the record element array has a lead record element, and wherein the pivot axis is coincident with the lead record element.

19. The matrix printer of claim 14, wherein the pivot axis is along the array axis.

20. The matrix printer of claim 14, wherein the pivot axis is off-set from the array axis.

21. The matrix printer of claim 1, wherein the record element array is mounted by the array mounting means at a fixed cant angle defining a fixed matrix row density along the advance direction and a fixed progressive delay.

22. A method of scaling an input image presented in an input pixel matrix formed by matrix rows of pixels and by matrix columns of pixels, into an output image printed in an output pixel matrix formed by matrix rows of pixels along a row scan direction and by matrix columns of pixels along a row advance direction, by selectively printing discrete pixel recording units on a recording medium, comprising the steps of:

providing a record element array having N uniformly spaced record elements, each record element having a position extending along an array axis at a first angle relative to the advance direction;

pivoting the record element array about a pivot axis from the first cant angle to a second cant angle altering the position of each record element along the scan direction receiving the input image presented in the input matrix;

providing source position compensation of each record element along the scan direction to compensate the input image for the change in cant angle of the record element array aligning the matrix columns of the output matrix with the advance direction;

providing shift compensation of each record element along the scan direction to prevent the second cant angle from causing a shift of the output image along the scan direction relative to the recording medium in accordance with the source position relationship;

$$\text{delta } P = D\,(\sin C' - \sin C)$$

where delta P is the alteration in position of the record element array along the scan direction, D is the distance along the record element array between the record element array and the pivot axis, C is the first cant angle, and C' is the second cant angle;

scanning the record element array relative to the recording medium along the scan direction generally perpendicular to the advance direction;

advancing the record element array relative to the recording medium along the advance direction; and selectively printing discrete recording units on the record medium during the scanning in response to the compensated output pixel matrix, the scanning spatially positioning the matrix columns of the output matrix along the scan direction of the output image as the recording units are printed, establishing a matrix column density along the scan direction in scaled correspondence with the input image, the advancing forming successive rasters of the N matrix rows of uniform inter-row spacing as the recording units are printed, establishing a matrix row density of the matrix rows along the advance direction in scaled correspondence with the input image.

* * * * *